United States Patent [19]

Metz

[11] Patent Number: 4,518,422

[45] Date of Patent: May 21, 1985

[54] PROCESS AND APPARATUS FOR REFINING STEEL IN A METALLURGICAL VESSEL

[75] Inventor: Paul Metz, Luxembourg, Luxembourg

[73] Assignee: Arbed S.A., Luxembourg, Luxembourg

[21] Appl. No.: 552,413

[22] Filed: Nov. 16, 1983

[30] Foreign Application Priority Data

Nov. 17, 1982 [LU] Luxembourg ..... 84472

[51] Int. Cl.[3] ..... C21C 7/02

[52] U.S. Cl. ..... 75/58; 75/53

[58] Field of Search ..... 75/53, 58, 51

[56] References Cited

U.S. PATENT DOCUMENTS 3,218,157 11/1965 Dobrowsky ..... 75/51
3,556,773 1/1971 Grenfell ..... 75/51
3,907,548 9/1975 Steinmetz ..... 75/51
3,980,469 9/1976 Forster ..... 75/58
4,130,417 12/1978 Breuer ..... 75/51

*Primary Examiner*—Peter D. Rosenberg
*Attorney, Agent, or Firm*—Fishman & Dionne

[57] ABSTRACT

A process and apparatus for the desulphurization, deoxidation and purification of a metal melt is presented. The process is particularly well suited for use in a ladle during the refining of steel. The present invention comprises means for defining at the surface of a melt at least a first working zone preferably via a plunger tube. Thereafter, combustible materials and oxygen are delivered to the working zone at a single impact point, preferably by a plurality of lances or by a multiple flow lance. As a result, a reactive high temperature slag is produced thereby. Finally, the melt is mixed so as to evenly distribute the heat preferably by permeable elements and/or at least one auxiliary lance.

41 Claims, 4 Drawing Figures

PROCESS AND APPARATUS FOR REFINING STEEL IN A METALLURGICAL VESSEL

BACKGROUND OF THE INVENTION

This invention relates to the field of metal refining. More particularly, this invention relates to a new and improved process and apparatus therefore for the metallurgical refining of steel in a ladle or similar vessel.

For several years, the steel industry has increasingly utilized ladles for a variety of metallugical processes. The more frequent use of these ladles has come about, in part, because of the recent development of continuous casting. Thus, the metallugical processes conventionally intended for the steel converter or electric oven prior to delivery to the casting equipment are now often being conducted in the ladle.

As noted, the refining processes conducted in the ladle are of various types and frequently include the following:

1. Processes involving dephosphorization;
2. Processes involving desulphurization via the injection of metallic desulphurizing materials such as calcium-silicon, Perrin slags or other slags consisting of lime and/or fluorspar. Other desulphurizing agents such as magnesium or calcium carbide have also been used. These injections are usually effected by entrainment in an inert or reducing carrier gas;
3. Deoxidation processes carried out by the addition or injection of aluminum, ferro-silicon, calcium-silicon, etc. Note that the processes of desulphurization and/or deoxidation can be combined;
4. Processes of heating by electric arc or by induction;
5. Processes of refining or purification of steel, either by vacuum or by simple bubbling with or without the addition of slags.

For a number of years, the assignee of the present invention has spent considerable efforts on developing and improving the above methods and has acquired particular expertise in regulating and controlling the metallugical reactions between the slag and the melt.

Pursuant to this extensive research and development, it has been unexpectedly discovered that the formation of certain reactive slags within the ladle will result in an acceleration and an improvement in the dephosphorization, desulphurization, deoxidation and purification processes discussed above while simultaneously permitting an easily manageable or controllable increase in the temperature of the metallic bath. These reactive slags are prepared via a combustion process by reacting oxygen with certain metals and subsequently adding other nonmetallic compounds.

SUMMARY OF THE INVENTION

In accordance with the present invention, a novel process and apparatus for improving the dephosphorization, desulphurization, deoxidation and purification of a metal melt during a plurality of refining steps are presented. The process of the present invention is particularly well suited for use in a ladle for steel, although other vessels such as ovens would equally suffice.

The process of the present invention comprises the delivery or injection via a blowing lance of combustible materials such as aluminum, calcium carbide, calcium silicon, calcium aluminum as well as other scorifying or slag forming materials such as lime and/or flourspar, all of which are entrained in an inert or reducing carrier gas. In addition, the process consists of simultaneously blowing oxygen to the same area in the ladle as the other additives so as to form reactive slags having the desired composition located at the point of impact.

The present invention permits the formation of a very hot and particularly reactive slag along with a corresponding and substantial increase in the temperature of the steel melt.

It has been found that the simple blowing operation as described above can give rise to a desirable increase in the temperature of the metal bath provided that the bath is stirred or put into motion by the blowing of an auxilary inert or reducing gas. This auxilary gas is preferably blown by one or more permeable elements located at the bottom of the ladle disposed below the point of impact of the blowing lance. The auxilary gas may also be injected by a secondary or auxilary lance wherein the output is fed substantially below the point of impact of the primary blowing lance. This auxilary blowing lance may be used alone or in conjunction with one or more permeable elements.

Another feature of the process according to the present invention consists of the simultaneous use of certain methods and devices in order to avoid direct contact between the slag covering the metal melt and the novel reacting slag formed during the above described blowing processes. These methods and devices, which will be described in more detail hereinafter, essentially consist of a plunger tube which allows access to the metal melt in the ladle while preventing the presence of the regular slag (which has been dragged along at the time of the transfer of the metal to the ladle from the converter), within the working area or working zone of the plunger tube.

It should be understood that the process of the present invention should not be undertaken until a sufficient quantity of a secondary slag has been formed at the impact point below the head of the blowing lance. In fact, it is not recommended to start the reaction of the present invention on the bare metal melt surface. Instead, a cushion of the secondary slag should be provided on the metal melt which could consist of, for example, lime, prefabricated solid or liquid slag, or a self-melting substance such as an exothermic powder.

The slag which covers the metal melt after ladle casting is subsequently removed to as great an extent as possible. In order to diminish the effects of the remaining slag residue, the bath surface is covered with a protective layer or coating, preferably comprised of lime. Next a cover or lid is lowered onto the rim of the ladle, thereby forming a section of the novel apparatus of the present invention and the treatment process is begun, preferably after separation of the working zone from the regular slag and preliminary formation of the secondary slag.

The apparatus of the present invention consists of a metallurgical ladle or similar vessel which has the capability of separating the working areas within the bath whereby means are provided to inject solid and gaseous materials into one working zone while simultaneously also providing means for introducing an ascending current of bubbling gas into that zone. Separation of the working areas is effected via a conventional plunger tube which is well known to those skilled in the art. This plunger tube is preferably equipped with a cap which permits penetration into a layer of slag and subsequently the bath. The plunger tube can be of the type having a single compartment or can be subdivided into several compartments. Preferably, the injection or delivery of solid and gaseous materials is achieved through one or more vertical blowing lances from above, while the bubbling gas for mixing is provided by permeable elements located in the bottom of the ladle and/or by a submerged auxilary lance. The permeable elements and submerged lance are positioned so as to direct the bubbling gas into the working area within the plunger tube.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
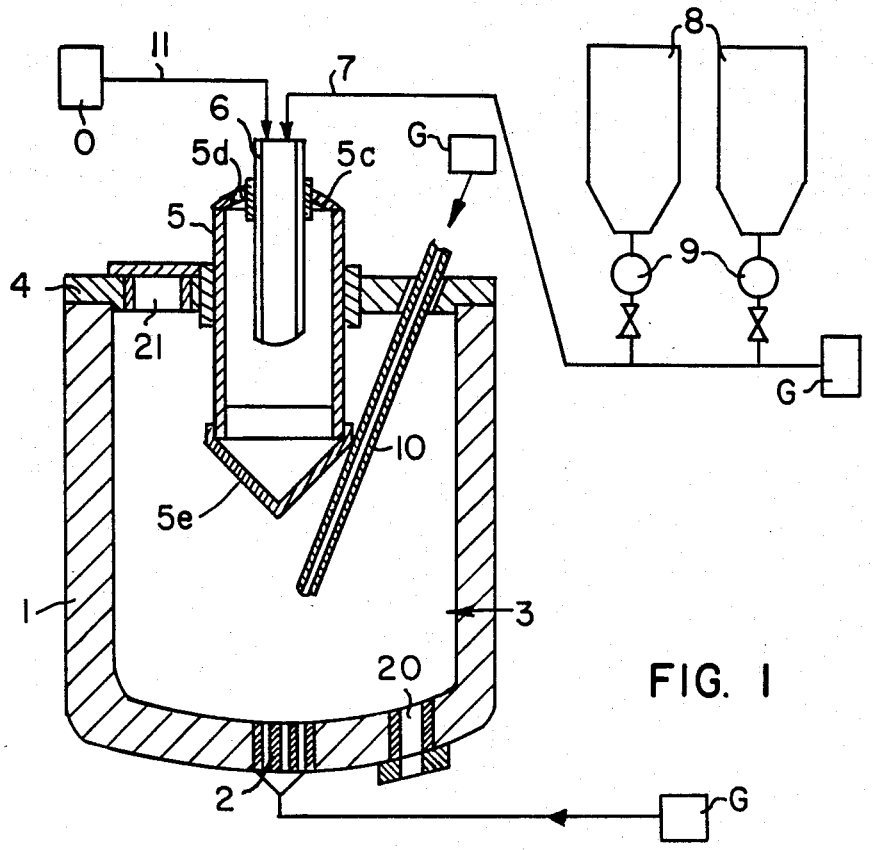
FIG. 1 is a cross sectional elevation view of an apparatus including a plunger tube and ladle in accordance with the present invention.

Referring first to FIG. 1, the ladle 1 is equipped with a refractory layer (not shown) and has a permeable element 2 at the bottom thereof which is used to inject inert or reducing bubbling gas G. While a single element 2 has been shown, any suitable number of elements may also be used. A cover or lid 4 which covers the ladle 1 is utilized both to prevent heat losses and to prevent ambient air from entering the ladle interior. The cover 4 also has a central opening therein which surrounds a plunger tube 5. The plunger tube 5 preferably has a cap 5*e* comprised of a thin metal sheet or the like located at the bottom thereof. This cap 5*e* permits the plunger 5 to pass through the regular slag layer floating on top of the steel 3 and prevents the regular slag from penetrating into the tube 5 interior. Thus, after the tube 5 is submerged into the bath 3, i.e., after the lid 4 is placed on the ladle 1, the cap 5*e* which has passed through the regular slag layer will subsequently melt in the liquid metal. Note that the bubbling created by gas injected at the bottom of the ladle 1 will often make it possible to avoid the use of a cap 5*e* by creating a zone free of regular slag in the vicinity of the tube 5. Tube 5 is also equipped with a cover or lid 5*c* which allows gas to escape from holes 5*d* therein. This lid 5*c* also includes an aperture to allow the introduction of a blowing lance 6, the lance 6 thereafter providing the solid and gaseous materials to the plunger tube 5.

Plunger tube 5 perferably includes interior and exterior protective refractory coatings (not shown). It has been found that the plunger tube 5 is subjected to relatively significant wear and abrasion caused, in part, by the high temperature present within the tube 5, and also from the corrosive attack of the particularly reactive compounds which are present within the tube 5. Therefore, in order to increase the life of the tube 5, it has been suggested that the internal surface of the tube 5 be coated with a special refractory material, for example, compounds of zirconium or of chromium-magnesium. Unfortunately, these coatings are both expensive and difficult to apply. In addition, such coatings must not only be capable of tolerating very high temperatures and withstanding the highly reactive slag types created in the tube 5, but must also be able to adhere well to the tube surface despite sudden rises or drops in temperature. It has been found particularly advantageous to utilize a coating comprised of materials which emit a gas capable of diminishing or eliminating contact between the tube 5 interior and the contents thereof. These preferred materials are derived from high temperature reactions in the metallic bath or the slags and/or with the combustion oxygen. In essence, any coating material having the properties hereinabove described, may be used so long as no undesirable by-product material are introduced into the metal bath upon decomposition. Obviously, it would be advantageous to choose or to include materials in the coating which decompose partially into compounds having a beneficial effect on the particular metallurgical treatment in the ladle.

Adequate protective coatings for the tube 5 have been obtained by applying calcium carbonate, magnesium carbonate, sodium carbonate, and other carbonates which have been mixed with suitable binders and applied to the tube according to well known methods. These coatings may also be deposited on the rest of the metallurgical ladle or similar vessel wherein the liquid metal comes into contact therewith. These coatings will then evolve carbon dioxide upon contact with the heat of the reactive liquid melt or upon contact with the metal bath or slag. Also, these particular protective coatings will provide an endothermic reaction which will act to oppose the corrosive effects of the high temperatures produced by the reactive slags.

The protective coatings of the present invention can also be comprised, in part, of combustible materials such as wood, and agglomerates of wood and/or cardboard. Accordingly, protective coatings may be provided which are comprised of a mixture of combustible materials and carbonates. For example, agglomerated wood or cardboard added to or impregnated with a carbonate, preferably the basic carbonates listed above, will work adequately as a protective coating in the present invention. In most applications, the protective coatings can be applied by conventional methods. In those situations wherein the coating cannot be applied by conventional scattering or equivalent techniques, then the structure or device to be protected by the coating must have a geometric configuration such that the coating is automatically held in position by the static pressure of the metal or slag against the coating and the structure. For example, a plunger tube would have to have a shape. similar to a funnel, which widens slightly in order for the coating to be held in place by the static pressure as described immediately above.

A single multiple flow or multiflow blowing lance (known in the art) may be employed in the present invention which is capable of feeding possibly incompatible gaseous and solid materials through separate channels thereof. Accordingly, contact between the incompatible materials such as, for example, a metallic aluminum powder and oxygen, must be avoided before exit at the lance mouth. To avoid the use of a complex and expensive blowing lance, it is also possible to provide two individual lances directed towards the same impact point, one of which will be used to deliver or inject the combustible materials carried by an inert gas and the other used to deliver the oxygen.

Referring again to FIG. 1, a single multiflow lance 6 is shown connected to a conduit 11 for supplying oxygen from a source O and a conduit 7 for delivering combustible materials. These combustible materials are stored in tanks 8 each provided with cellular regulators 9. Conduit 7 is connected to a source of gas G which can be either a reducing gas or an inert carrier gas. Also shown in FIG. 1 is an auxilary lance 10 which may provide the bubbling gas G. Lance 10 may be used in place of or in conjunction with permeable elements 2, especially in the cases where the feed gas from the permeable elements 2 has proven to be insufficient to adequately distribute the heat created in the bath by the process of the present invention. The additional lance 10 may also be used to effectively purify the bath by an extended contact between the metal melt and the purifying slags created in the ladle 1. Lastly, ladle 1 is provided with a system of tapholes shown at 20.

As discussed earlier, the process of the present invention comprises the delivery or injection into the working zone of the plunger tubes of combustible materials such as aluminum, calcium carbide, calcium silicon, calcium aluminum as well as other scorifying or slag forming materials such as lime and/or flourspar, all which are entrained in an inert or reducing carrier gas. These materials are preferably delivered via a blowing lance as discussed earlier. In addition, the process consists of simultaneously blowing oxygen to the same work areas in the plunger tube as the other additives so as to form. reactive slags having the desired composition located at the point of impact. The present invention therefore permits the formation of a very hot and particularly reactive secondary slag along with a corresponding and substantial increase in the temperature of the steel melt.

It has been found that the simple blowing operation as described above can give rise to a desirable increase in the temperature of the metal bath provided that the bath is stirred or put into motion by the blowing of an auxilary inert or reducing gas. This auxilary gas is preferably blown by one or more permeable elements located at the bottom of the ladle disposed below the point of impact of the blowing lance. The auxilary gas may also be injected by a secondary or auxilary lance wherein the output is fed substantially below the point of impact of the primary blowing lance. This auxilary blowing lance may be used alone or in conjunction with one or more permeable elements.

Figure 2:
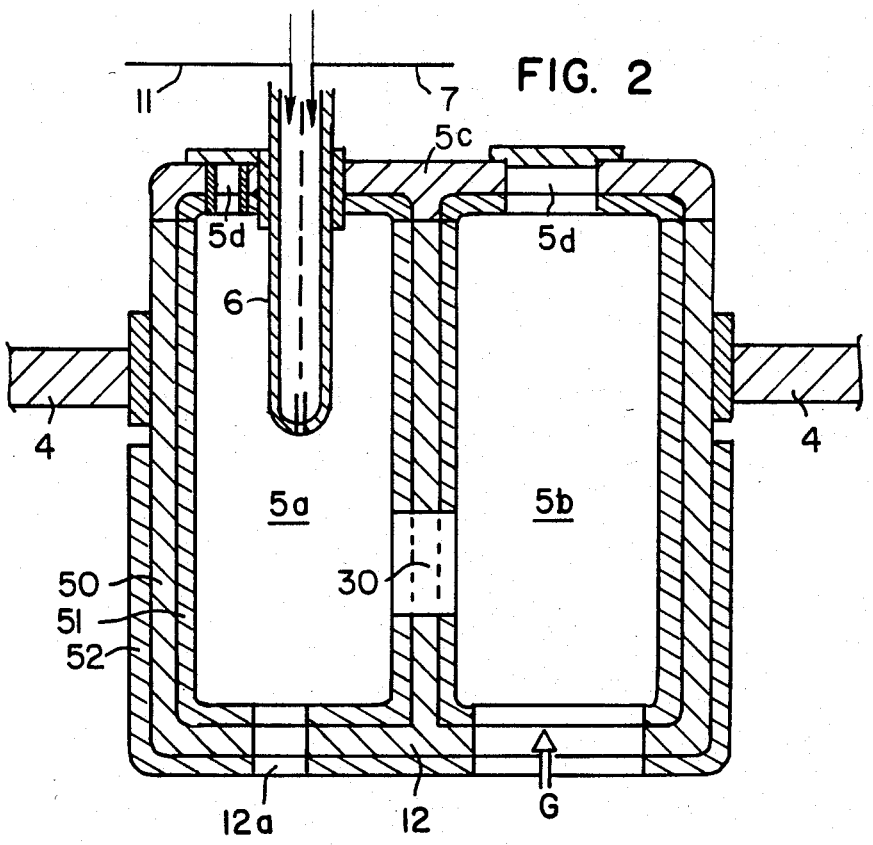
FIG. 2 is a cross sectional elevation view of a plunger having two compartments similar to the plunger of FIG. 1 and in accordance with the present invention.

Referring now to FIG. 2, a plunger tube 50 is shown. The principal feature of plunger tube 50 which differs from plunger tube 5 of FIG. 1 consists of the subdivision of the inner compartment into two compartments 5*a* and 5*b*. Compartment 5*a* constitutes the working zone within the tube 50 which receives the solid materials and oxygen which are introduced by means of a lance 6. Compartment 5*b* communicates with compartment 5*a* through opening 30 located between the wall separating the two compartments. Compartment 5*a* is provided at its base with a bottom 12 having a relatively small aperture 12*a* while compartment 5*b* is essentially open at the bottom thereof. Note that plunger tube 50 has an interior thermal protective coating 51 as well as an exterior protective coating 52. These coatings will be comprised of those materials discussed earlier for plunger 5. Plunger tube 50 also is provided with a cover 5*c*having holes 5*d* therein which allow gas to escape therethrough.

The purpose of the plunger tube 50 configuration of FIG. 2 is to obtain as complete a combustion as possible of the materials delivered into the compartment 5*a*. Note that the metal heating and refining processes will essentially take place in compartment 5*b* which contains only the secondary heating and refining slag and a very small amount of deoxidizing substances. This double tube 50 is preferably used when steels having a very low deoxidizing material content are desired. Obviously, when using tube 50, it is necessary that the permeable elements 2 or lance 10 providing the bubbling gas G be disposed below compartment 5*b* wherein the refining operation and heat exchanging is taking place. Thus, the secondary slag formed in compartment 5*a* overflows into compartment 5*b* wherein an intense bubbling is produced between the metal and the hot slag.

In embodiments wherein the double tube 50 is employed, it is no longer necessary to deliver the heating and refining mixture by means of a blowing lance and a carrier gas as in the previous embodiment in FIG. 1. It has thus been found that it is enough to permit the combustion materials to run out, i.e., freely fall into zone 5*a* and subsequently to inject the oxygen necessary for the combustion of the thermogenic (i.e., heat producing) materials in this zone. This avoids the use of expensive multiflow lance devices. Note that care should be taken to create sufficient turbulence within working zone of compartment 5*a*, this turbulence can be created by the oxygen from the blowing lance.

Figure 3:
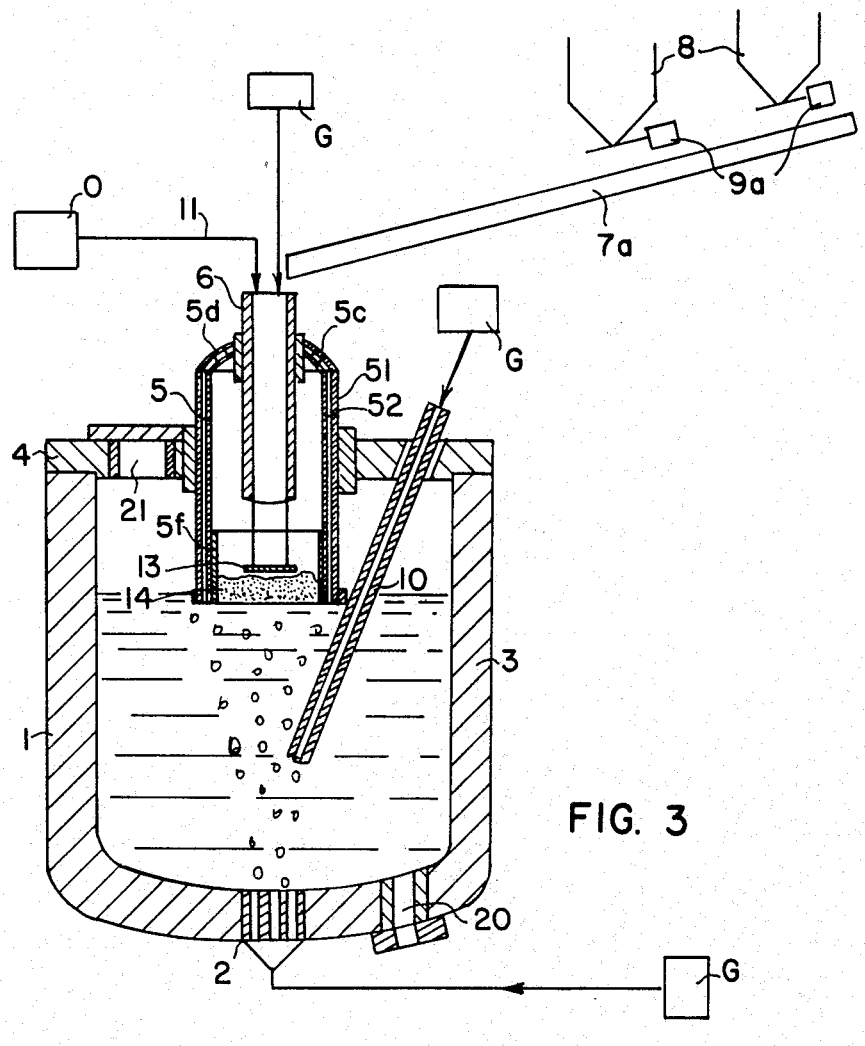
FIG. 3 is a cross sectional elevation view, similar to FIG. 1, of another embodiment of a steel making apparatus in accordance with the present invention.

A plunger tube 50, as shown in FIG. 2, has a rather complex structure and is difficult and expensive to maintain. A simpler and less expensive apparatus and process which may be used in order to avoid contact between the metallic bath and the combustible materials, such as oxygen, is shown in FIG. 3 as plate 13. This plate is positioned at the point of impact or fall of the combustible materials and the oxygen. The plate 13 must be set up in such a way that the reactions between the combustible or thermogenic materials and the oxygen takes place on the plate 13. Subsequently, the slag formed thereon will overflow the plate and hence come into contact with the metallic bath. Turbulence is needed to impart motion to the metallic bath. This turbulence may be provided by auxilary reducing or inert gas which is blown through either one of the several permeable elements 2 situated at the bottom of the ladle or by the auxilary lance 10 which also feeds into the melt below the point of impact. In FIG. 3, the structural elements having identical configurations as in FIG. 1 are given the same reference numerals. Thus, the plate 13, on which the combustible materials react with the oxygen, is suspended and fixed in the throat 6 of the tube 5. The combustible materials are stored in tanks 8, provided at their base with vibrating regulators or feeders 9*a* feeding into a vibrating chute 7*a*. This particular process can also be performed by a vertical drop through a chute feeding means and into a gate (not shown) in throat 6. Throat 6 will preferably be water cooled. An inert or reducing gas G will prevent penetration by gas slag or metal into the tube 5. The internal portion of tube 5 may be provided with a protective covering 5*f* which may be comprised of wood impregnated with a magnesium material, preferably two centimeters in thickness.

Figure 4:
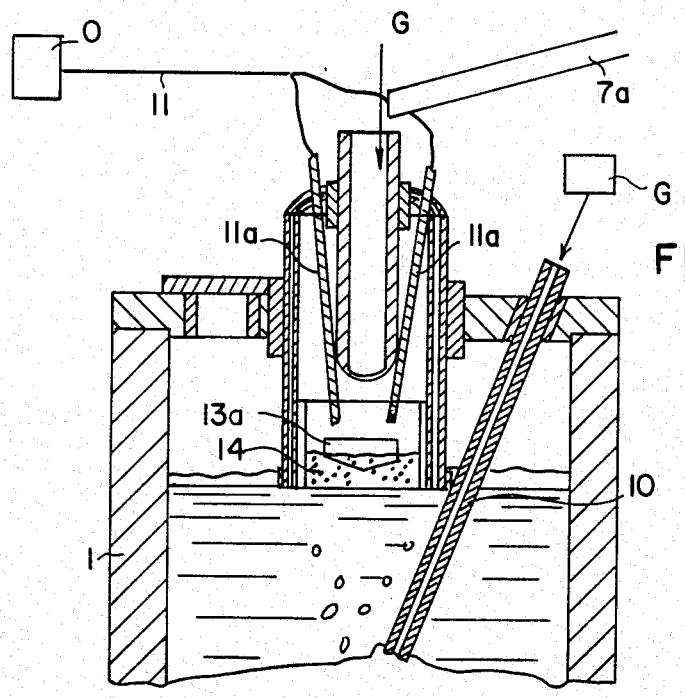
FIG. 4 is a cross sectional elevation view, similar to FIG. 1, of yet another embodiment of a steel making apparatus in accordance with the present invention.

In yet another embodiment of the present invention shown in FIG. 4, the oxygen is introduced into plunger tube 5 by means of two lances 11*a* which are preferably water cooled. Lances 11*a* are connected to the oxygen conduit 11 and are disposed across from a cuvette-like element 13*a* which floats in a layer of slag 14. The cuvette 13*a* includes a centering structure (not shown) which allows it to be centered accordingly. The cuvette 13*a* is also equipped with a cone, the tip of which is directed downward so that it will freely move with the motion of the bath. This bath motion is provided by gas which is blown in from the bottom via permeable elements and/or an auxilary blowing lance 10.

The following examples are particularly well suited for those devices and apparatii shown in either FIGS. 1 or 2:

EXAMPLE 1

In this example, the ladle 1 contains 120 tons of steel flowing from a converter in which the steel had a temperature of 1,610° C. and a sulfur content of 0.015%. The metal is skimmed of the majority of slag which had come from the converter. Next, the ladle is covered with a layer of powdered lime which acts to neutralize the remainder of the slag floating in the ladle. Bubbling and mixing is then produced by introducing a neutral gas G through the permeable elements 2 and/or the bubbling lance 10. In this way, a zone free of slag and of lime is obtained within the ladle so that the plunger tube 5 may be introduced therein. Thereby, effecting a separation between the regular slag and the secondary reactive slag to be formed in the plunger tube 5. The object of this particular example is to reduce the sulfur content and to heat the metal to 1,670° C. thereby making it possible to continuously cast the metal for 50 minutes.

The heat generating or thermogenic material blown into the ladle is aluminum in a powdered or granulated form mixed with a calcium carbide which is also in powder or granular form. This combustible material should be in a ratio of about 1.6 kg of $CaC_2$ to 0.74 kg of Al, and perhaps 3 to 10% of $CaF_2$ which is intended to improve the fluidity of the slag.

It has been found that the metallic bath temperature is increased by 18° C. if 1 kg of this mixture is delivered per ton of steel with 0.7 to 0.9 cubic meters of oxygen. In order to obtain a temperature increase of 60° C., it is necessary therefore to inject 3.3 kg of mixture per ton of steel, or 400 kg of a mixture of Al $CaC_2$, without taking into account the 20 kg of calcium fluoride intended to regulate the viscosity of the slag. The 400 kg of the mixture of aluminum and calcium carbide are injected within a period of 20 minutes into the ladle. This injection will correspond to a temperature increase of 3° C. per minute. Throughout the entire operation, an intense current of argon gas is injected through the permeable element 2 and/or through auxilary lance 10. The argon injection is continued for five minutes after the initial injection. After this inert gas operation, the desired temperature of 1,670° C. was reached and the metal contained only about 0.004% of sulfur along with excellent micrographic purity.

EXAMPLE 2

It will be obvious to one skilled in the art that the particular portions and quantities to be added during the process of the present invention are a function of the type of materials which are to be injected therein. Thus, to produce for example, a Perrin slag in accordance with the present invention, a mixture of 35% aluminum and 65% calcium oxide must be utilized. The resultant temperature rise will be about 20° C. per kg of aluminum added per ton of steel. It will also be necessary to provide 0.6–0.7 cubic meters of oxygen per kg of added aluminum.

EXAMPLE 3

It may also be desirable to utilize a calcium aluminum alloy in order to produce a purifying slag and to simultaneously heat the steel. In particular, a suitable mixture will comprise 50% calcium aluminum and 50% calcium oxide having an additional additive of 5 to 10% fluorspar as a fluidifier. This particular mixture will provide an increase of from 16° to 20° C. per kg of calcium aluminum added per ton of steel while producing a steel titrating less than 0.004% sulfur having a correspondingly good micrographic purity.

The following examples are particularly well suited for use in those structures and configurations of the present invention shown in FIGS. 3 and 4:

EXAMPLE 4

The ladle 1 contains 100 tons of steel flowing from a converter in which the steel had a temperature of 1,610° C. The metal contained in the ladle has been given additions of ferromanganese, aluminum, silicon, etc. to correspond to its final desired composition. The metal is skimmed of the majority of slag which had come from the converter. The ladle temperature at this point is 1,575° C. Next, the ladle is covered with a layer of powdered lime which acts to neutralize the remainder of the slag floating in the ladle. Bubbling and mixing is then produced by introducing a neutral gas G through the permeable elements 2 and/or the bubbling lance 10. In this way, a zone free of slag and of lime is obtained within the ladle so that the plunger tube 5 having its interior and exterior formed of a refractory material may be introduced therein. Next, a layer consisting of 50% kg prefabricated slag is introduced into tube 5 and the addition of a mixture of calcium carbide and bauxite having a high aluminum oxide $Al_2O_3$ content is begun. The mixture will then consist of approximately 70% aluminum oxide $Al_2O_3$ which has been previously calculated in a ratio of 1 kg of calcim carbide per 1.25 kg of bauxite so as to produce a slag titrating approximately at 50% of CaO and 50% of $Al_2O_3$ (disregarding impurities). Simultaneously, oxygen is introduced through lances 11*a*. Following this series of steps, the final temperature reach should be about 1,605° C., while the thermal losses during the operation will be about 0.3° C. per minute.

The above described mixture which has been injected with the oxygen will allow the temperature in the ladle to be raised 8° C. per kg of $CaC_2$ per ton of steel. This is an effective increase of 3° C. per minute. Finally, an injection into the path of about 6.25 kg of $CaC_2$ and 7.8 kg per ton of bauxite per ton of steel as well as 3.75 cubic meters of oxygen per ton of steel is made into the bath. A neutral gas G is also injected through the permeable elements and/or the auxilary lance. The result is a remarkably and unexpectedly purified steel along with a desirably increased temperature.

During the manufacture of many grades of steel, it will not be necessary or even useful to use calcic-aluminous slags, since a calcic slag leads to desulfurization and remarkable deoxidation of the metal without the introduction of traces of aluminum into the metallic bath. The effect of metallic aluminum in the bath can be extremely disruptive for certain grades of steel.

EXAMPLE 5

The following example is an application of the use of calcium carbide either alone or with the possible addition of small amounts of fluorspar for the purpose of improving the fluidity of the slag there obtained. This particular example will relate to a high carbon grade of steel for ultra-fine drying in which any addition of aluminum is prohibited.

As in the preceding example, the temperature of the 100 tons of steel in the converter will be about 1,610° C. while the temperature in the clean ladle will be about 1,535° C. including the grading and recarbonization. The procedure will be conducted exactly as in the previous example, with the layer of prefabricated slag being replaced by a mixture of 60 kg of lime and 10 kg of fluorspar being introduced into tube 5. This will be followed by the addition of calcium carbide in grains ranging in size of from 2 to 4 millimeters to which 10% of fluorspar will be added. Oxygen is simultaneously delivered to lances 11*a* via the calcium carbide jet, care being taken not to totally burn the calcium carbide in the finally formed slag so as to maintain the deoxidizing and desulfurizing effects in the slag. The final temperature of the melt will be about 1,560° C.

The calcium carbide combined with the addition of fluorspar and oxygen will be injected in such a way as to produce a reducing slag. This involves a temperature increase of about 7° C. per kg of $CaC_2$ per ton of steel. The desired increase of 50% (30° C. for effectively heating and 20° C. to compensate for the heat loss incurred during the operation which is about 1.3° C. per minute) will require the addition of 7 kg of $CaC_2$ and 3.64 cubic meters of oxygen per ton of steel. As in the previous examples, the necessary mixing is obtained by use of a neutral gas G. Thus, the present example will provide a significantly purifying effect without traces of aluminum in the steel along with the desired increase in temperature.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A process for refining steel in a metallurgical vessel having a metal melt therein, said melt having a first slag thereon, including the steps of:

delivering a combustible material to a working zone at an impact point at the surface of said melt;

delivering oxygen to said working zone at said impact point whereby a highly reactive second slag is produced therein; and mixing said melt whereby heat is evenly distributed therethrough.

2. The process according to claim 1 including:

delivering a nonmetallic scorifying material to said impact point.

3. The process according to claim 2 wherein:

said scorifying material is selected from the group consisting of lime and flourspar.

4. The process according to claim 1 wherein:

said mixing is effected by an inert gas delivered through permeable element, said permeable element being located at the bottom of said vessel disposed beneath said impact point.

5. The process according to claim 1 wherein:

said mixing is effected by an inert gas delivered through at least one auxilary lance disposed below said impact point.

6. The process according to claim 1 including:

separating said first slag on said melt from said working zone whereby said reactive second slag formed therein will not contact said first slag.

7. The process according to claim 1 including:

adding a third slag to said working zone prior to producing said second slag.

8. The process according to claim 7 wherein:

said third slag is selected from the group consisting of a prefabricated slag, lime or an exothermic powder.

9. The process according to claim 1 including:

adding a layer of lime to said surface of said melt.

10. The process according to claim 1 wherein:

said combustible material is selected from the group consisting of metallic aluminum, calcium carbide, calciumsilicon and calcium-aluminum.

11. The process according to claim 1 wherein:

said metallurgical vessel is a ladle.

12. The process according to claim 1 wherein:

said separate working zone is provided by plunger tube means.

13. The process according to claim 12 including:

coating said plunger tube means with a coating material which emits a gas capable of diminishing contact between said tube and the contents thereof.

14. The process according to claim 13 wherein:

said coating material is a carbonate compound mixed with a binder.

15. The process according to claim 14 wherein:

said carbonate is selected from the group consisting of calcium carbonate, magnesium carbonate and sodium carbonate.

16. The process according to claim 13 wherein:

said coating material is a combustible material.

17. The process according to claim 16 wherein:

said combustible material is selected from the group consisting of wood, cardboard, wood impregnated with a carbonate compound and cardboard inpregnated with a carbonate compound.

18. An apparatus for refining steel in a metallurgical vessel having a metal melt therein, said melt having a first slag thereon, including:

means for separating the surface of said melt to define at least one working zone;

means for delivering a combustible material to said working zone at an impact point;

means for delivering oxygen to said working zone at said impact point whereby a highly reactive second slag is produced therein; and means for mixing said melt whereby heat is evenly distributed therethrough.

19. The apparatus according to claim 18 wherein said separating means comprises:

plunger tube means, said plunger tube means having a longitudinal throat therethrough.

20. The apparatus according to claim 19 wherein:

said plunger tube means has a disposable cap thereon whereby said tube means may pass through said first slag into said melt.

21. The apparatus according to claim 18 including:

a cover located on said vessel, said cover having an opening therein to permit said separating means to be positioned therethrough.

22. The apparatus according to claim 19 wherein:

said plunger tube means has one compartment therein.

23. The apparatus according to claim 19 wherein:

said plunger tube means has a plate within said throat positioned at said impact point.

24. The apparatus according to claim 23 wherein:

said plate is suspended and fixed within said throat of said tube means.

25. The apparatus according to claim 19 wherein:

said plunger tube mean has a cuvette within the throat therein corresponding to said impact point.

26. The apparatus according to claim 25 wherein:

said cuvette floats on said melt, said cuvette having a bottom portion with a cone shape.

27. The apparatus according to claim 19 wherein:

said plunger tube means has a first compartment and a second compartment therein.

28. The apparatus according to claim 27 wherein:

said first compartment and second compartment communicates through an opening therebetween;

said first compartment having means to receive said means for delivering said combustible material and said oxygen;

said second compartment having an opening at the bottom thereof.

29. The apparatus according to claim 28 including:

said mixing means being disposed beneath said bottom opening of said second compartment.

30. The apparatus according to claim 18 wherein said delivering means for delivering both oxygen and combustible material comprises:

at least one vertical blowing lance, said blowing lance disposed within said separating means.

31. The apparatus according to claim 30 wherein:

said lance is a multiple flow lance.

32. The apparatus according to claim 18 wherein:

said combustible delivery means comprises a first lance carrying solid materials entrained in a carrier gas;

said oxygen delivery means comprises a second blowing lance;

said first and second lances delivering said solid materials and said gases to said impact point.

33. The apparatus according to claim 18 wherein said mixing means comprises:

at least one permeable element, said permeable element being located at the bottom of said vessel disposed beneath said impact point, said permeable element having an inert gas flowing therethrough.

34. The apparatus according to claim 18 wherein said mixing means comprises:

at least one auxilary lance disposed below said impact point, said permeable elements having an inert gas flowing therethrough.

35. The apparatus according to claim 19 wherein said plunger tube means includes:

a coating material which emits a gas capable of diminishing contact between said tube and the contents thereof.

36. The apparatus according to claim 35 wherein:

said coating material is a carbonate compound mixed with a binder.

37. The apparatus according to claim 36 wherein:

said carbonate is selected from the group consisting of calcium carbonate, magnesium carbonate and sodium carbonate.

38. The apparatus according to claim 35 wherein:

said coating material is a combustible material.

39. The apparatus according to claim 38 wherein:

said combustible material is selected from the group consisting of wood, cardboard, wood impregnated with a carbonate compound and cardboard impregnated with a carbonate compound.

40. The apparatus according to claim 39 wherein:

said metallurgical vessel is a ladle.

41. The apparatus according to claim 18 wherein:

said separating means separates said first slag on said melt from said working zone whereby said reactive second slag found therein will not contact said first slag.

* * * * *

US004518422B1

REEXAMINATION CERTIFICATE (3778th)

United States Patent [19]

Metz

[11] B1 4,518,422

[45] Certificate Issued Jun. 8, 1999

[54] PROCESS AND APPARATUS FOR REFINING STEEL IN A METALLURGICAL VESSEL

[75] Inventor: Paul Metz, Luxembourg, Luxembourg

[73] Assignee: Paul Wurth S.A., Luxembourg, Luxembourg

Reexamination Request:
No. 90/004,983, May 7, 1998

Reexamination Certificate for:

| | |
|---|---|
| Patent No.: | **4,518,422** |
| Issued: | **May 21, 1985** |
| Appl. No.: | **06/552,413** |
| Filed: | **Nov. 16, 1983** |

[30] Foreign Application Priority Data

Nov. 17, 1982 [LU] Luxembourg ..... 84472

[51] Int. Cl.[6] ..... C21C 7/076; C22B 9/10

[52] U.S. Cl. ..... 75/540; 75/542; 75/543; 266/221; 266/223

[58] Field of Search ..... 75/533, 537, 539, 75/540, 542, 543; 266/221, 222, 225, 223

[56] References Cited

U.S. PATENT DOCUMENTS

| | | | |
|---|---|---|---|
| 2,851,351 | 9/1958 | Cuscoleca et al. | 75/543 |
| 3,971,655 | 7/1976 | Takashima et al. . | |

FOREIGN PATENT DOCUMENTS

| | | |
|---|---|---|
| 1959173 | 11/1969 | Germany . |
| 1965136 | 12/1969 | Germany . |
| 50-159812 | 12/1975 | Japan . |
| 53-149826 | 12/1978 | Japan . |
| 56-96008 | 8/1981 | Japan . |
| 1362637 | 8/1974 | United Kingdom . |

OTHER PUBLICATIONS

Revue de Metallurgie—CIT, Dec. 1980 "In-ladle metallurgical practices in converter steel plants", J.P. Motte and R. Vasse (IRSID), pp. 981–994 (in French), pp. 15–28 (English translation).

*Primary Examiner*—Melvyn Andrews

[57] ABSTRACT

A process and apparatus for the desulphurization, deoxidation and purification of a metal melt is presented. The process is particularly well suited for use in a ladle during the refining of steel. The present invention comprises means for defining at the surface of a melt at least a first working zone preferably via a plunger tube. Thereafter, combustible materials and oxygen are delivered to the working zone at a single impact point, preferably by a plurality of lances or by a multiple flow lance. As a result, a reactive high temperature slag is produced thereby. Finally, the melt is mixed so as to evenly distribute the heat preferably by permeable elements and/or at least one auxiliary lance.

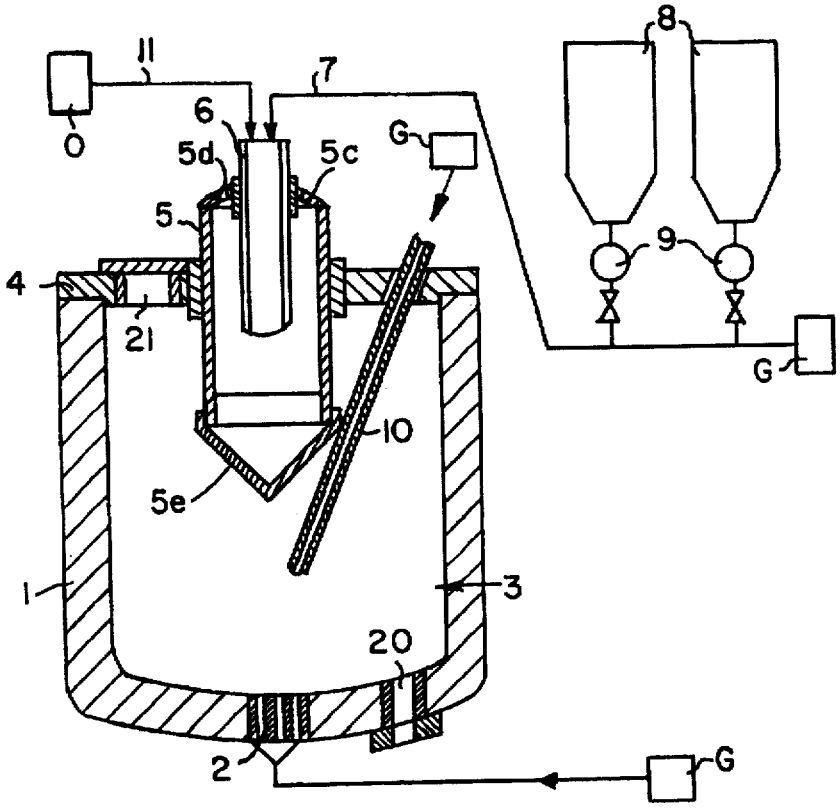

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 18 to 33 and 35 to 41 is confirmed.

Claim 34 is cancelled.

Claims 1 and 6 are determined to be patentable as amended.

Claims 2 to 5 and 7 to 17, dependent on an amended claim, are determined to be patentable.

1. A process for refining steel in a metallurgical vessel having a metal melt therein, said melt having a *surface with a* first slag thereon, including the steps of:

*separating said first slag on said melt to define a working zone;* delivering a combustible material to [a] *said* working zone at an impact point at the surface of said melt;

delivering oxygen to said working zone at said impact point whereby a highly reactive second slag is produced therein; and mixing said melt whereby heat is evenly distributed therethrough.

6. [The process according to claim 1 including] *A process for refining steel in a metallurgical vessel having a metal melt therein, said melt having a surface with a first slag thereon, including the steps of*:

separating said first slag on said melt [from said] *to define a* working zone*;*

*delivering a combustible material to said working zone at an impact point at the surface of the melt;*

*delivering oxygen to said working zone at said impact point whereby a highly reactive second slag is produced therein,* whereby said reactive second slag [formed therein] will not contact said first slag*; and*

*mixing said melt whereby heat is evenly distributed therethrough.*

* * * * *